United States Patent [19]

Sayles

[11] Patent Number: 4,530,728

[45] Date of Patent: Jul. 23, 1985

[54] EXPANDING EMBEDMENT RESIN FOR COMPOSITE-MODIFIED DOUBLE-BASE PROPELLANTS

[75] Inventor: David C. Sayles, Huntsville, Ala.

[73] Assignee: The United States of America as represented by the Secretary of the Army, Washington, D.C.

[21] Appl. No.: 669,146

[22] Filed: Nov. 7, 1984

[51] Int. Cl.[3] ..... C06B 45/10

[52] U.S. Cl. ..... 149/19.6; 149/15; 149/21; 149/38; 149/42; 149/76; 149/92; 149/98; 149/113; 149/114; 102/285; 102/289; 102/290

[58] Field of Search ..... 149/19.6, 15, 21, 98, 149/92, 76, 38, 42, 113, 114; 102/285, 289, 290

[56] References Cited

U.S. PATENT DOCUMENTS

| | | | |
|---|---|---|---|
| 3,965,676 | 6/1976 | Schaffling | 149/15 |
| 4,029,529 | 6/1977 | Elrick | 149/19.6 |
| 4,131,051 | 12/1978 | Schaffling | 264/3 R |
| 4,441,942 | 4/1984 | Sayles | 149/19.6 |

OTHER PUBLICATIONS

Bailey, W. J. et al, Journal of Poly. Sc: Poly. Chem. Ed., vol. 14, pp. 1735–1741, (1976).

*Primary Examiner*—Stephen J. Lechert, Jr.

*Attorney, Agent, or Firm*—Anthony T. Lane; Robert P. Gibson; Jack W. Voigt

[57] ABSTRACT

An embedment system with controlled shrinkage for use with a composite-modified double-base propellant composition which is comprised of an embedment granule portion in percent by weight of nitrocellulose of about 23.0, nitroglycerine of about 8.8–13.8, triacetin of about 1.2, bisspiro orthocarbonate from about 2.5–5.0, resorcinol of about 1.5, 2-nitrodiphenylamine of about 1.0, ammonium perchlorate (10 micrometers) of about 48.5 and aluminum powder (20 micrometers) of about 10.0 and an embedment resin portion in percent by weight of bisphenol A-epichlorohydrin of about 50.0, epoxidized dimer acid of about 50.0, and a curative which is comprised of equal parts mixture of methylenedianiline, m-phenylenediamine, and i-propyl-m-phenylenediamine with an added accelerator of 2,4-dinitrophenol. This embedment system employs a specific bisspiro orthocarbonate, 3,9-bis(5′-norbornene-2′-yl)-1,5,7,11-tetraoxaspiro[5.5]undecane, which effects elimination or reduction of amount of shrinkage that the resin undergoes during curing. As a result, the embedment granules are more securely locked into the embedment resin. On solvation, the casebond tensile strength and peel strength are markedly improved, and casebond failures attributable to the pulling out of the embedment granules from the embedment resin does not take place. In this system, the failure occurs within the propellant during pull and peel tests.

2 Claims, 2 Drawing Figures

EXPANDING EMBEDMENT RESIN FOR COMPOSITE-MODIFIED DOUBLE-BASE PROPELLANTS

DEDICATORY CLAUSE

The invention described herein may be manufactured, used, and licensed by or for the Government for governmental purposes without the payment to me of any royalties thereon.

BACKGROUND OF THE INVENTION

The composition of the interfacial system between the composite-modified double-base solid propellant grain and insulation in a missile motor is generally comprised of an embedment powder and an embedment resin which comprises an embedment system. Compatibility between the grain composition and the embedment system is necessary since this system functions as an interface between the propellant grain and the insulation system. Requirements for the embedment system include a high peel strength and a resistance to penetration by, or absorption of, catalyst components or casting solvent components contained in the propellant composition. Without proper peel strength and resistance to penetration the bond strength to the propellant and insulation is adversely effected. Failure of the bond in the embedment system would result in a sudden major increase in the burning surfaces of the propellant, and possible rupture of the motor case due to overpressurization. The burning rate of the propellant grain would also be adversely affected as well as the smooth burning rate because of poor adhesion to the embedment system.

An embedment system for use in conjunction with a crosslinked, carboranyl-catalyzed, composite-modified, double-base propellant composition is designed to have as close a similarity to the propellant as possible from compatibility considerations but still must differ so that its burning rate is as low as possible (approaching zero burning) as a consequence the embedment layer differs from the propellant composition with which it is used in the following aspects: the embedment powder contains no carboranyl burning rate accelerator, no aluminum whiskers, and the particle size of the ammonium perchlorate is of considerably larger weight-mean-diameter. The other portion of the embedment system is an embedment resin portion composed of the diglycidyl ether of bisphenol A (EPON 828) and epoxidized Dimer* acid (EPON 871). (Emery Industries of Cincinnati, Ohio is a major supplier of dimerized oleic acid which is marketed as Dimer* acid.) The curative presently used consists of a blend of meta-phenylenediamine, methylenedianiline, isopropyl meta-phenylenediamine, and dinitrophenol as accelerator. This system is a diamine-cured epoxy embedment system.

The above described embedment system has several limitations and has proven to be unsatisfactory because of lower than required peel strength and a lower resistance to penetration by, and absorption of, the catalyst and the casting solvent from the propellant composition.

The polyimide embedment system for composite-modified double-base propellant disclosed in my U.S. Pat. No. 4,441,942, filed Jan. 3, 1983 and issued Apr. 10, 1984, has superior characteristics when compared to the characteristics of a diamine-cured epoxy embedment system. The polyimide embedment system of the above U.S. Patent, assigned to The United States of America as represented by the Secretary of the Army, Washington, D.C., is comprised of an embedment granule portion in combination with a substituted polybismaleimide prepared by the interaction or condensation of 2 moles of 1,2-bis(maleimido)ethane with one mole of triaminotriazine(melamine) at 80°-100° C. to yield the low-molecular weight reaction prepolymer (e.g., molecular weight range=2000-2500). This prepolymer, when incorporated into the embedment resin matrix, reacts with epoxy resins. The embedment system when cured has improved peel strength and greater resistance to penetration by or absorption of carboranylmethyl propionate (catalyst) or casting solvent absorption, however, the shrinkage of the resin when cured detracts from the embedment system mechanical properties.

An object of this invention is to provide an embedment system with controlled shrinkage for use with a composite-modified double-base propellant composition.

A further object of this invention is to provide shrinkage control by incorporating a bisspiro orthocarbonate into the embedment system composition which results in an expansion during curing to offset shrinkage normally encountered when resins undergo curing.

SUMMARY OF THE INVENTION

An improvement in the embedment resin for composite-modified double-base propellants, and particularly in the embedment layer whose function is to bond the embedment powder portion securely into the embedment resin, is achieved by incorporation of a bisspiro orthocarbonate into the embedment resin. The embedment layer, on one side, is bonded to the solid propellant, and, on the other side, is bonded to the insulation of the missile motor case. Incorporation of the bisspiro orthocarbonate effects elimination or reduction of the shrinkage that the embedment resin undergoes. As a result, the embedment granules are more securely locked into the embedment resin. On solvation, the casebond tensile strengths and peel strengths are markedly improved, and casebond failure attributable to the pulling out of the embedment granules from the embedment resin does not take place. In this system, the failure occurs within the propellant per se.

Figure 1:
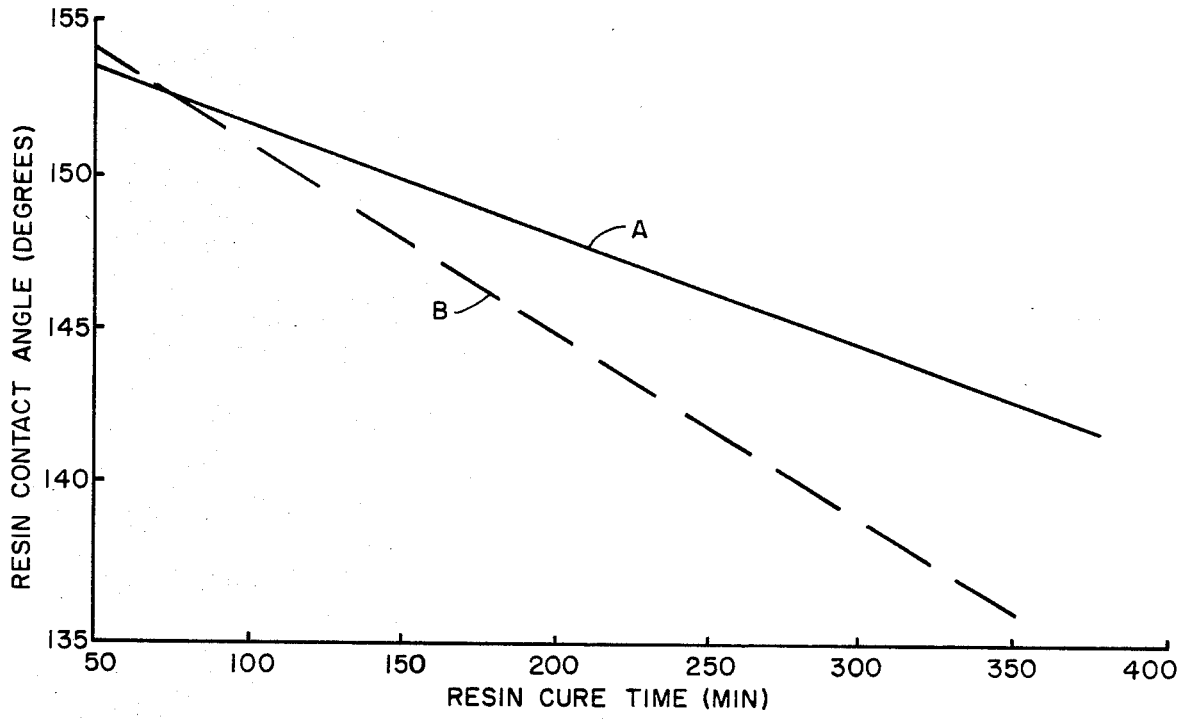
FIG. 1 of the drawing depicts the resin contact angles in degrees between embedment granules and embedment resin of an unmodified epoxy embedment resin and a spiro-modified embedment epoxy resin, and FIG. 2 of the drawing depicts a comparison of the pulling forces during resin curing time of embedment granules and embedment resin of an unmodified resin and a spiro-modified resin.

The improved embedment layer of this invention is comprised of an embedment powder portion as follows:

| Ingredient | Parts by weight |
|---|---|
| Nitrocellulose | 23.0 |
| Nitroglycerine | 10.0 (range 8.8-13.8) |
| Triacetin | 1.2 |
| Bisspiro orthocarbonate | 3.8 (range 2.5-5.0) |
| Resorcinol | 1.5 |
| 2-Nitrodiphenylamine | 1.0 |
| Ammonium perchlorate (10/μm) | 48.5 |

-continued

| Ingredient | Parts by weight |
|---|---|
| Aluminum powder (20/μm) | 11.0 |

, and an embedment resin portion as follows:

| Ingredient | Parts by weight |
|---|---|
| EPON 828* | 50.0 |
| EPON 871** | 50.0 |
| Curative*** | 15.0 |

*Bisphenol A-epichlorohydrin
**Epoxidized Dimer acid
***Blend of meta-phenylenediamine, methylenedianiline, isopropyl meta-phenylenediamine, and dinitrophenol as accelerator

DESCRIPTION OF THE PREFERRED EMBODIMENT

An improved expanding embedment resin for composite-modified double-base propellants effects the bonding of the solid propellant, on one side, and, on the other side, the insulation layer of a missile motor case. Fabrication of the embedment layer is done in such a manner so that part of the embedment powder protrudes and is available for solvation by the casting solvent and interaction with the polyisocyanate (of the propellant composition) whose function is to crosslink the embedment powder in the embedment layer with the casting powder of the propellant. This improved embedment layer composition containing a bisspiro orthocarbonate which eliminates shrinkage normally encountered when epoxy resins or other polymers undergo curing is disclosed hereinbelow along with the improvement to the embedment layer composition mechanical properties.

The incorporation of the bisspiro orthocarbonate, 3,9-bis(5'-norbornene-2'-yl)-1,5,7,11-tetraoxaspiro[5.5]undecane into the embedment resin effects elimination or reduction of the amount of shrinkage that this resin undergoes. As a result, the embedment granules are more securely locked into the embedment resin. On solvation, the casebond tensile strength and peel strength are markedly improved, and casebond failures attributable to the pulling out of the embedment granules from the embedment resin does not take place. In this system, the failure occurs within the propellant.

The embedment layer composition containing a bisspiro orthocarbonate and how the bisspiro orthocarbonate effects the embedment layer, is set forth hereinbelow in Table I.

TABLE I

Effect of Bisspiro Orthocarbonate on the Embedment Layer

| Ingredient | Embedment Layer 1 | Embedment Layer 2 |
|---|---|---|
| Composition (Embedment Powder) | | |
| Nitrocellulose | 23.0 | 23.0 |
| Nitroglycerine | 13.8 | 10.0 |
| Triacetin | 1.2 | 1.2 |
| Bisspiro Orthocarbonate | — | 3.8 |
| Resorcinol | 1.5 | 1.5 |
| 2-Nitrodiphenylamine | 1.0 | 1.0 |
| Ammonium Perchlorate (10/μm) | 48.5 | 48.5 |
| Aluminum Powder (20/μm) | 11.0 | 11.0 |
| Composition (Embedment Resin) | | |
| EPON 828 | 50 | 50 |
| EPON 871 | 50 | 50 |
| Curative: | 15 | 15 |
| Methylenedianiline | | |
| m-Phenylenediamine | | |
| i-Pr-m-Phenylenediamine | | |
| Accelerator: | | |
| 2,4-Dinitrophenol | | |

The procedure for the synthesis of the specific bisspiro orthocarbonate set forth in Table I, i.e., 3,9bis(5'-norbornene-2'-yl)-1,5,7,11-tetraoxaspiro[5.5]undecane, is presented below, in descriptive language and by reaction equation in Table II.

3,9-Bis(5'-norbornene-2'-yl)-1,5,7,11-tetraoxaspiro[5.5]undecane

The Diels-Alder reaction of cyclopentadiene (33 g/0.5 mole) (obtained by pyrolysis of dicyclopentadiene) and acrolein (28 g/0.5 mole) was performed under gentle reflux in benzene (100 ml) for 7 hours. After the benzene has been removed by evaporation at reduced pressure, the residue was distilled at reduced pressure to give 5-norbornene-2-carboxyaldehyde (56 g) (92%), bp 76°-77°/33 mm.

After a mixture of 5-norbornene-2-carboxyaldehyde (24.4 g/0.2 mole), methanol (100 ml), and 30% formalin (50 g) was heated at 70°-75° for 3 hours, potassium hydroxide (11.2 g) (35% aqueous solution) was added over a period of 1 hour to give 5-norbornene-2,2-dimethanol (21 g) (70%). This crude product was recrystallized from benzene to give a pure product, mp 110°.

A mixture of 5-norbornene-2,2-dimethanol (31 g/0.2 mole), dibutylstannic oxide (50 g/0.2 mole), and toluene (400 ml) was charged into a 1-liter flask equipped with a Dean-Stark trap. The reaction was gently heated under reflux for about 10 hours to collect an almost theoretical amount of water which was produced during the reaction. After the reaction had been cooled, carbon disulfide (16 g/0.21 mole) was added slowly to the mixture. The resulting mixture was again gently heated under reflux for about 10 hours. It was then cooled to precipitate the product, which was isolated by decanting off the toluene, and by extraction with a small portion of acetone. It was purified by two sublimations under reduced pressure to give yield of 3,9-bis(5'-norbornene-2'-yl)-1,5,7,11-tetraoxaspiro[5.5]undecane (15 g) (47%), mp 240°.

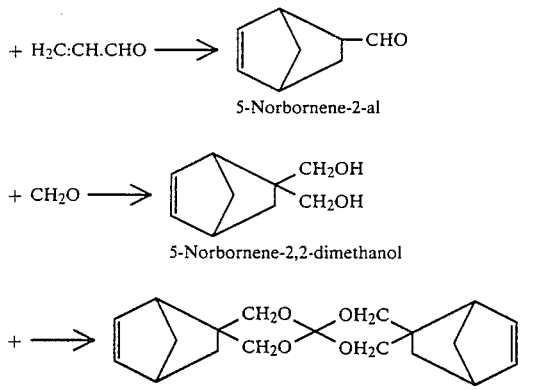

FIG. I - Synthesis of 3,9-Bis(5'-Norbornene-2'yl)-1,5,7,11-Tetraoxaspiro[5,5]undecane The procedure employed in applying the embedment layer to the interior surface of the insulation which lines the inner surface of the motor case is as follows:

a. The embedment resin is sprayed onto the inner surface of the motor case as it is being rotated and as the spray head is moved down the motor case length. Several passes are made until the desired thickness is achieved, b. The resin is "B-staged" by being heated at 300°-350° F. for 3-4 hours.

c. The embedment powder is then introduced into the motor at the rate of two pounds of powder per foot of motor case length, d. The polar openings are sealed, and the motor case is rotated for several additional hours, e. The resin is then allowed to cure at 120° for 16-24 hours.

The ideal embedment should be such that half of the powder protrudes from the embedment resin, and the other half of the powder granule is embedded in the resin.

The compositions of the embedment powder and resin are presented in Table 1.

a. Dogbone specimens of the cured embedment resin system are prepared, and elongation is determined.

b. After the embedment granules are embedded into the embedment resin, the surface area coverage is photographed and counted for uniformity of their dispersion. Depth of embedment of the embedment powder into the resin is determined visually. During "B-staging", tack time is followed using an ASTM specification which involves dropping a steel ball onto the resin specimen.

c. Casebond tensile strength is determined by machining off the beaker or sleeve down to the styrene-butadiene rubber (SBR) insulation. The rubber and propellant are bonded to steel plates, and pulled at 2.0 in/in/min speed until failure.

d. For the peel test, this involves cutting 1-inch strips. Fiber ducking is bonded to the rubber so that it does not stretch. The propellant is bonded to a cellulose acetate plate. Peel strength is determined by pulling on the ducking at 90°.

| Casebond Properties | I | II |
|---|---|---|
| Tensile Strength (psi) | 186 | 215 |
| Peel Strength (pli) | 105 | 143 |

EPON 828 and EPON 871 employed in the embedment resin are shown below by names and structural formulae.

EPON 828, Diglycidyl Ether of Bisphenol A

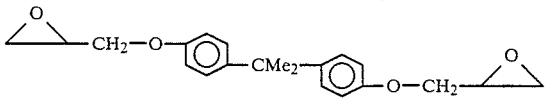

EPON 871 Epoxidized Dimer (Dimerized Oleic Acid) Acid

-continued

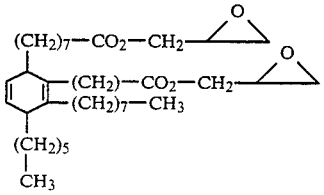

The adhesive bond between the embedment resin and the embedment powder granules is mechanical in nature, and does not involve any chemical bonds. The mechanical failure of this interface can occur as a result of inadequate wetting of the granules by the resin. In general, the better a particle is wetted by the resin, the stronger the adhesive bond between particle and cured resin will be. The wetting ability of a liquid can be quantified by measuring the contact angle between the surface of the solid particle and the plane of the liquid at the point where the liquid contacts the solid particle.

The contact angle and its relationship to adhesion to the resins was evaluated by pushing individual embedment granules into contact with the resin films at different time intervals after the resin composition was mixed. The resins were then cured, and the granules were pulled out, and the cavity that was left in the resin was examined. The cavity was sliced longitudinally across its diameter, and the sectioned resin surface was photographed at high magnification. The angle between the cylindrical wall and the plane of the resin at the point of contact was measured. A plot of contact angle vs resin cure time (from the time of mixing) is depicted in FIG. 1. This plot showed that the spiro-modified epoxy resin blend B wet the granules more effectively than the unmodified resin blend A.

The strength of the adhesion between the embedment granules and cured resin was determined by measuring the load required to extract the individual granules of embedment powder from the cured resin. Microscope slides were spread with resin, and a number of granules (75 mil) were placed (a) just in contact with the edge of the resin strip, and (b) on top of the resin strip.

Figure 2:
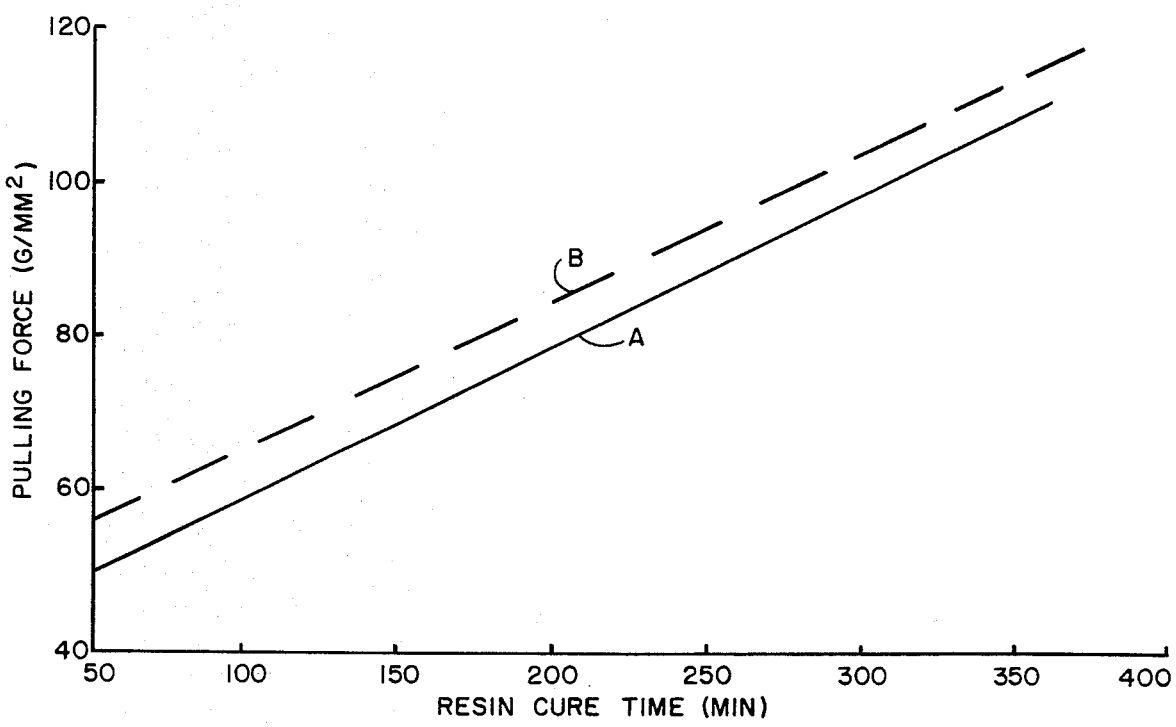

After the resins were cured, a wire loop was placed around the individual powder granule, and a shear force was applied. This pulling force caused the release of the resin from the cylindrical wall of the granule. The force required to achieve the first indication of adhesive failure, at a strain rate of 0.02 in/min was measured to normalize the adhesive force to a unit of area coverage of the granule. The cavity in the resin was then sectioned, photographed, measured, and the area of resin coverage was calculated. One-half of this area since the initial adhesive failure occurred only on one side of the cylinder was used in the calculation of the adhesive force. Measurements were made at various times between resin mixing and granule contact. The comparative data are plotted in FIG. 2.

The data indicate that the resin-to-granule adhesion decreased with time between resin mixing and embedment granule addition, and that a major improvement occurred when the bisspiro orthocarbonate was incorporated into the resin. Comparative embedment studies showed that the unmodified epoxy blend A required 6 hours of cure time to achieve a satisfactory embedment whereas the modified epoxy blend B (containing the bisspiro orthocarbonate) achieved satisfactory embedment in about 4 hours.

The mechanical properties of the two resins (unmodified embedment resin and the bisspiro-modified embedment resin) were tested by casting the resins into $\frac{1}{8}$-thick dogbone tensile specimen that were $\frac{1}{2}$-inch wide at the gage section. The specimens were tested at 77° F. at a crosshead speed of 0.2 in/min. The data, listed in Table II show that the modified resin possessed higher stress and strain capability than the unmodified resin.

TABLE II

Comparison of the Mechanical Properties of Modified and Unmodified Embedment Resins

| PROPERTY | UNMODIFIED RESIN | MODIFIED RESIN |
|---|---|---|
| Tensile Strength (psi) | 2800 | 3500 |
| Elongation (%) | 55 | 63 |

I claim:

1. An embedment system with controlled shrinkage for use with a composite-modified double-base propellant composition, said embedment system comprised of an embedment granule portion (A) which comprises ingredients (i–viii) in percent by weight as follows:

(A) embedment granule portion:

(i) nitrocellulose: 23.0;

(ii) nitroglycerine 8.8–13.8;

(iii) triacetin: 1.2;

(iv) bisspiro orthocarbonate: 2.5–5.0;

(v) resorcinol: 1.5;

(vi) 2-nitrodiphenylamine: 1.0;

(vii) ammonium perchlorate (10 micrometers weight-mean-diameter particle size) 48.5; and, (viii) aluminum powder (20 micrometers weight-mean-diameter particle size): 10.0; and, an embedment resin portion (B) which comprises ingredients (i–iii) in percent by weight as follows:

(B) embedment resin portion:

(i) bisphenol A epichlorohydrin: 50.0

(ii) epoxidized dimer acid: 50.0

(iii) curative: 15.0 comprised of equal parts mixture of methylenedianiline
m-phenylenediamine and
i-propyl-m-phenylenediamine with an added accelerator of 2,4-dinitrophenol.

2. The embedment system as defined in claim 1 wherein said bisspiro orthocarbonate is 3,9-bis(5′-norbornene-2′-yl)-1,5,7,11-tetraoxaspiro[5.5]undecane which is present in an amount of about 3.8 percent by weight and wherein said nitroglycerin which is present in an amount of about 10.0.

* * * * *